US005159726A

United States Patent [19]

Bloch et al.

[11] Patent Number: 5,159,726

[45] Date of Patent: Nov. 3, 1992

[54] CONTROLLED-RIGIDITY SUPPORTING ELEMENT

[75] Inventors: Gérard Bloch; Jean Loeb, both of Strasbourg, France

[73] Assignee: CESA - Compagnie Europeenne de Sieges Pour Automobiles, France

[21] Appl. No.: 720,520

[22] PCT Filed: Jan. 2, 1990

[86] PCT No.: PCT/FR90/00001

§ 371 Date: Jul. 8, 1991

§ 102(e) Date: Jul. 8, 1991

[87] PCT Pub. No.: WO90/07890

PCT Pub. Date: Jul. 26, 1990

[30] Foreign Application Priority Data

Jan. 10, 1989 [FR] France ..... 89 00197

[51] Int. Cl.[5] ..... A47C 7/46

[52] U.S. Cl. ..... 5/453; 5/654; 5/910; 297/DIG. 3

[58] Field of Search ..... 5/450, 481, 448, 453, 5/653, 654, 910, 935, 634; 297/284 E, 284 R, DIG. 3, DIG. 1; 128/889

[56] References Cited

U.S. PATENT DOCUMENTS 3,608,961 9/1971 Von Heck ..... 297/284 R 3,730,588 5/1973 Braun ..... 297/452

FOREIGN PATENT DOCUMENTS 2319999 2/1977 France ..... 128/889

*Primary Examiner*—Alexander Grosz

*Attorney, Agent, or Firm*—Sughrue, Mion, Zinn, Macpeak & Seas

[57] ABSTRACT

A supporting element having a rigidity which may be adjustably controlled includes a cover (29) and a filler (30). The filler includes a flexible laminated structure having a plurality of layers (31, 32, 33; 32*a*, 32*b*; 34) which are mounted to be moveable relative to one another under the effect of a non-uniform distribution of force compressing the filler in the absence of a controlled pressure. The cover (29) is coupled to a vacuum source and is adapted to receive a controlled pressure to make the supporting element more or less rigid. When the cover (29) has a predetermined inner pressure, the relative displacement of the respective layers is prevented thereby giving the layers a predetermined rigidity. The layers may have a device for immobilizing the layers distributed on either side of at least one compressible layers (32, 32*a*, 32*b*).

18 Claims, 3 Drawing Sheets

CONTROLLED-RIGIDITY SUPPORTING ELEMENT

The invention relates to controlled-rigidity supporting elements comprising a cover which is subject to a control pressure.

The invention applies, by way of non-limiting examples, to pieces of furniture such as individual seats, bench seats or sofas.

The invention relates more particularly to a supporting element which can be adapted to the shape of any user whatsoever in order to obtain retention and support in an anatomically correct position which gives rise to no phenomenon of fatigue and causes no deformation of the spine which is likely to cause lordosis or kyphosis.

BACKGROUND OF THE INVENTION

The publication FR-A 2,096,133 describes a seat in which the squab is equipped with a cushion containing a resiliently compressible porous mass connected to a reduced-pressure source. This source adjusts the thickness of the cushion until its rigidity is sufficient to resist the compression caused by the load communicated by the user of the seat. It has been found, however, that such a design of the squab is poorly suited to the requirements of lateral retention of the trunk and of sacrolumbar lordosis during the changes in posture of the user of the seat.

The publication EP-A 0,113,613 describes a seat including a partitioned PVC cover containing a layer of particles such as polystyrene balls. This cover is connected by means of a pipe to a vacuum pump. Once suction has been established, the walls of the cover compress the polystyrene balls without any substantial variation in volume, creating a coherence between the balls which hardens the layer in the position required by the sitting position of the user of the seat.

The bursting of the balls following external vibrations and friction communicated to the cover results in a total loss of effectiveness of the lining element. Furthermore, it proves difficult to distribute the balls satisfactorily when the cover is situated in a non-horizontal plane.

The publication EP-A-267,640 describes a cover for surgical use which is capable of preserving a shape by the vacuum effect and in which balls are held in place by adhesive bonding on layers of non-woven fabric or in a plastic network produced by injection-molding.

The publication DE-GM 7,617,960 furthermore discloses a backrest consisting of pneumatic sleeves. Pumps, each equipped with an outlet valve, make it possible to adjust individually the internal pressure of each sleeve and to adapt the backrest to the requirements of the user. It is difficult to modify the support effect while the vehicle is moving, in particular for the driver, and it is possible only if the operating member has been designed in order to be used with just one hand.

SUMMARY OF THE INVENTION

The subject of the invention is a controlled-rigidity supporting element comprising an outer cover and an inner filler which is improved with the aim of avoiding the disadvantages which were noted with ball fillers.

According to the invention, the filler consists of a flexible laminated structure, the various strata of which are mounted with relative displacement under the effect of a non-uniform distribution of the force compressing the filler in the absence of any control pressure, and the cover of which is subjected to a variation in pressure in order to eliminate any relative displacement between the various strata, giving them the necessary rigidity.

The supporting element constructed in this way fulfils the function of rigidification and finds its place, for example, in the manufacture of coverings associated with adjustment devices with inflatable air pockets.

It will be able, in particular, to have a substantially more reduced constant thickness, irrespective of the position of use, and to be obtained easily using automated cutting-out methods.

BRIEF DESCRIPTION OF THE DRAWINGS

Other features and advantages of the invention will emerge upon reading the description of illustrative embodiments of the supporting element and of an example of the manufacture of a seat which makes use of the supporting element, with reference to the attached drawing, in which.

DETAILED DESCRIPTION OF THE PREFERRED EMBODIMENTS

Figure 1:
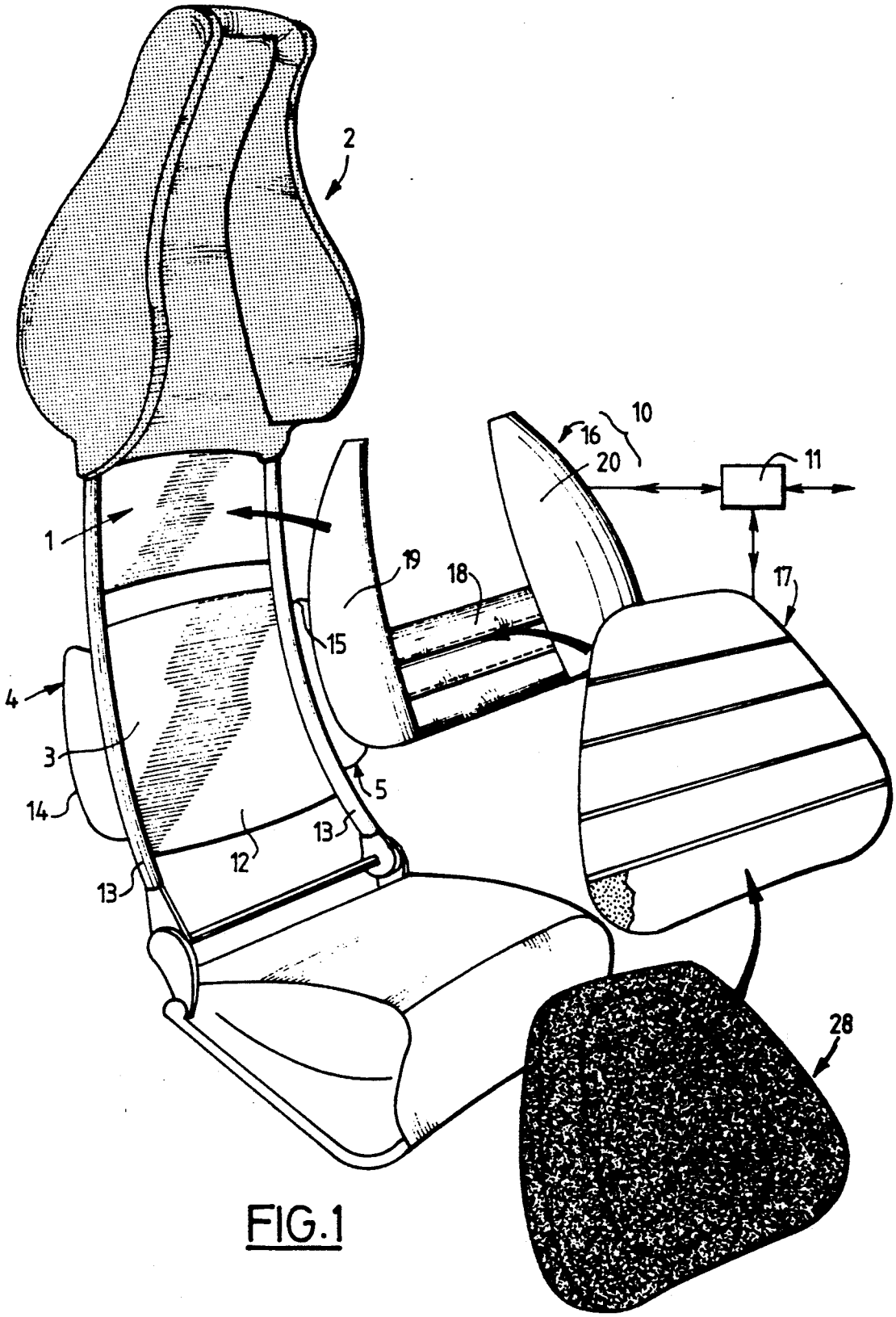
FIG. 1 shows in perspective the frame of the seat with a set of rests mounted on the squab.

FIG. 1 shows a backrest zone 3 arranged on the frame of the squab 1 of a motor vehicle seat covered with a padding 2.

The backrest zone 3 is extended on the left and the right by two side rest zones 4, 5. An adjustment system 10, worked via operating members such as a manipulator unit 11, rests, on the one hand, on the rigid frame 12 which defines the loading surface of the squab and which is fixed, in a known manner, between the side posts 13 of the frame of the squab and, on the other hand, on supports 14, 15 for the additional padding cushions respectively carried by the side posts 13. The adjustment system 10 is covered by a covering 28 of fibers agglomerated by an appropriate binder, in order to give the seat the desired permeability and ventilation and to ensure better distribution of the pressures of the trunk on the squab. The adjustment system 10 and the covering of fibers are covered by the padding 2 and consequently constitute the assembly of backrest 3 and side rests 4, 5.

The adjustment system here consists of two superposed supporting elements 16, 17, the size of which can be modified by varying their internal pressure. To this end, each of the elements 16, 17 consists of a hollow member, the walls of which are impermeable to gas. The unit 16 which rests on the frame 12 has a shape which is predetermined by the assembly of three compartmentalized inflatable cushions 18, 19, 20, the general configuration of which corresponds with the various rest zones 3, 4, 5 and which are joined together so as to define three capacities which can be inflated separately or simultaneously under the action of inflation pulses communicated by the manipulator unit.

Figure 2:
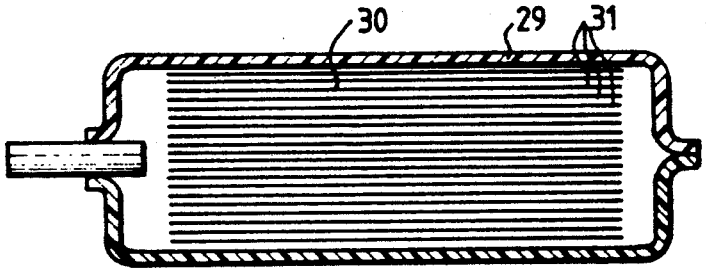
FIG. 2 is a sectional view of the supporting element consisting of a sealed outer cover surrounding an inner laminated filler of superposed sheets.

The element 17 as shown in FIG. 2 consists of an outer cover 29 connected via the manipulator to a vacuum source forming part of a pneumatic control device, an illustrative embodiment of which has been described in the publication EP-A 0,113,613.

A filler 30 is contained in the cover 29 and consists of an assembly of pliable and flexible sheets 31 constituting a layer which can be deformed under the effect of a non-uniform distribution of the compressive force. By way of example, the substance constituting the sheets can be paper, textile, plastic or metal which are capable of relative displacements under the effect of a deformation and the physical properties (texture—thickness—coefficients of friction) of which are adapted to the qualities of rigidity required for the element 17 when the cover 29 is in communication with the vacuum source. In this case, the rigidity is obtained by immobilizing the sheets under pressure by friction forces or following an embedding or locking effect.

To this end, the sheets 31 can have different properties and exhibit a surface with buttons or spikes which can be engaged in recesses or meshes of a grid. The sheets can also have perforations, be cut away or possess rigidification elements (plates, rings etc.) in order to facilitate the application of a reduced pressure to the cover, to increase the rigidity of the filler, to improve the cohesion between the sheets or to avoid the formation of wrinkles.

In what follows, identical elements or members forming part of the composition of the various fillers 30 will be designated by the same reference numerals.

Figure 3:
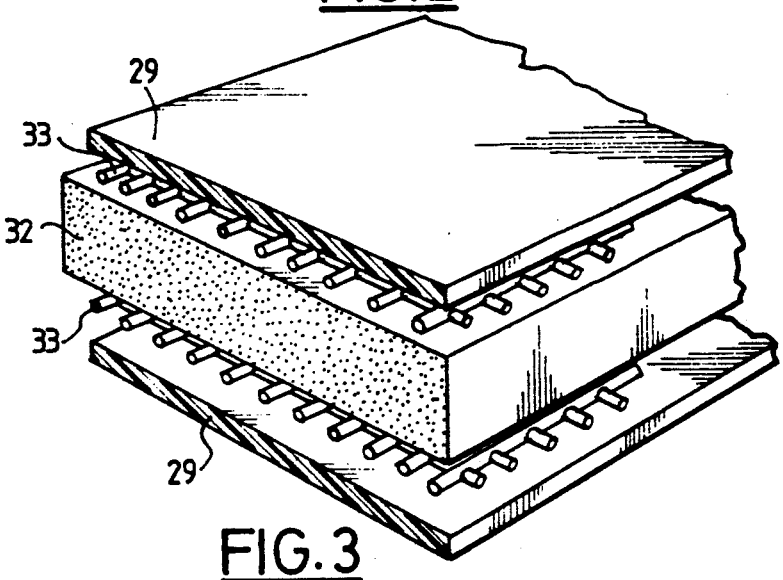
FIG. 3 is a perspective view of the supporting element consisting of a sealed outer cover surrounding a laminated inner filler with the incorporation of one or more compressible strata, and of grids permitting an embedding effect.

The element in FIG. 3 consequently comprises a filler 30 consisting of at least one stratum formed in a block 32 of compressible foam rubber arranged between two grids 33 in order to obtain penetration of the block 32 into the meshes of the grid when the cover 29 is connected to the vacuum source. The thickness of the block 32 is determined as a function of the desired rigidity.

A mechanical link is consequently made between the strata 32, 33 following the application of a reduced pressure to the cover 29.

Figure 4:
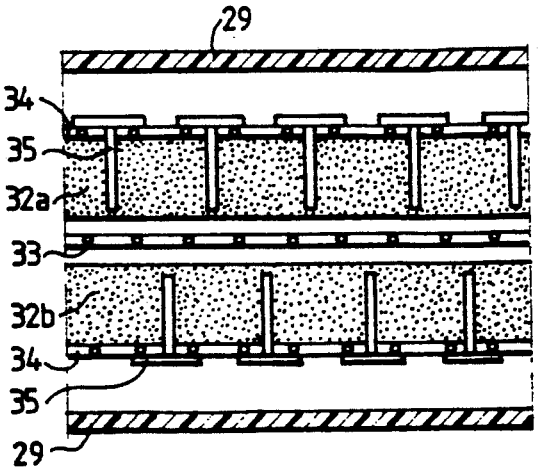
FIG. 4 is a sectional view of an alternative embodiment of the supporting element employing mechanical means for immobilization by a locking effect.
Figure 5:
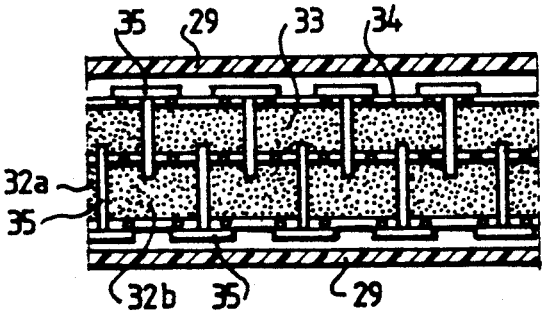
FIG. 5 shows the alternative embodiment in FIG. 4 after a vacuum has been applied to the cover, FIG. 6 refers to an alternative embodiment of the supporting element as shown in FIG. 4, FIGS. 7*a*, 7*b*–8*a*, 8*b* describe alternative embodiments of the supporting element, in which the mechanical means for immobilization connect together the outer strata directly through the central stratum or strata, FIG. 9 describes another alternative embodiment of the supporting element, in which the sealed cover is situated inside the supporting element.

The elements shown in FIGS. 4 and 5 comprises a filler similar to that in FIG. 3, in which the central stratum consists of a grid such as 33 arranged between two blocks **32*a* and 32*b* which are themselves in contact with two grids 34. Each of the grids 34 carries spikes 35 positioned perpendicularly to the blocks 32*a*, 32*b* and pointing through the said blocks towards the central grid 33**.

When the element is subjected to a compressive force which imparts a curvature to it, the grids 34 and the blocks **32*a*, 32*b* are displaced relative to the grid 33**.

When the cover 29 is connected to the vacuum source, the spikes 35 of the grids 34 embed themselves in the meshes of the grid 33 and improve the abovementioned mechanical link by connecting together the two grids 34 by a locking effect. In the process, the blocks **32*a*, 32*b*, the thickness of which is slightly greater than the effective length of the spikes 35, are compressed and the spikes 35 embed themselves in the grid 33. On the other hand, when the cover 29 is in communication with atmospheric pressure, the blocks 32*a*, 32*b* resume their initial state and the spikes 35 are automatically disconnected from the grid 33 by an unlocking effect. In the event of a change in curvature of the filler 30, the spikes 35 embed themselves in other meshes of the grid 33**. The reversibility of the locking and the unlocking enables the shape of the supporting element to be modified as desired.

Figure 6:
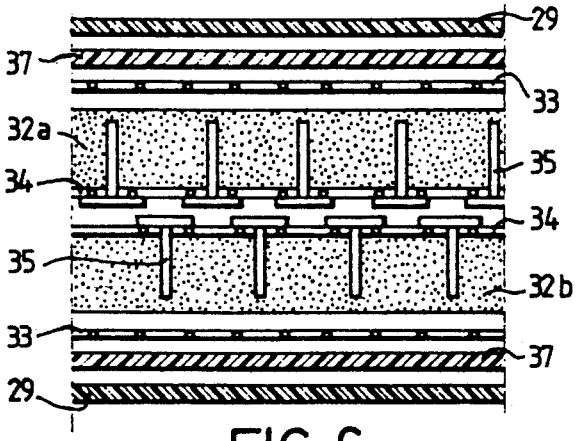
Figure 7A:
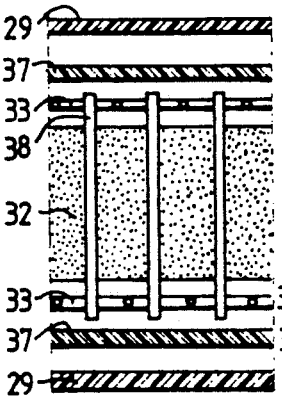
Figure 7B:
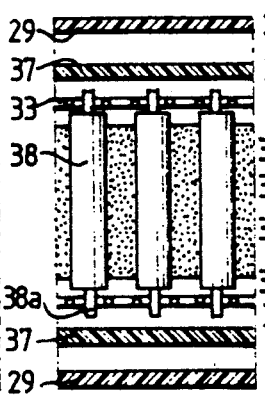

According to the illustrative embodiment shown in FIG. 6, the central stratum is formed by two sets of spikes 35 mounted opposite each other and integrally joined to two grids 34. It will, however, be possible in certain configurations of the element to use only one grid such as 34 to which the spikes 35 are integrally joined and point in two opposite directions normal to the grid towards outer grids 33, respectively traversing two compressible blocks **32*a*, 32*b***.

The abovementioned assembly is protected by outer strata 37 in order to protect the cover 29 from possible perforations.

In FIGS. **7*a*, 7*b*, the spikes 35 are replaced by bars 38 linking the outer grids 33 through the compressible central block 32**.

The bars 38 can have a cylindrical body of larger diameter which is designed to preserve a substantially constant spacing between the grids 33, as indicated in FIG. **7*b*, while studs 38*a* situated at the end of the said bars are engaged in the meshes of the grids 33**.

Figure 8A:
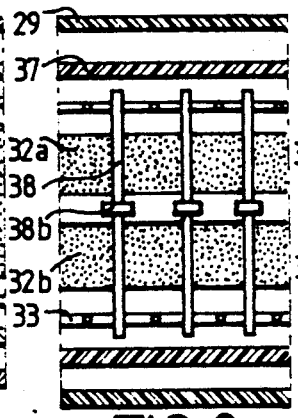
Figure 8B:
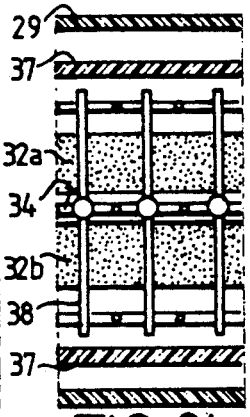

In FIG. **8*a*, the bars 38 have a central enlargement 38*b* and extend through an assembly of two compressible blocks 32*a*, 32*b*. In FIG. 8*b*, the bars 38 are integrally joined to a central stratum or grid 34**. The purpose of these devices is to achieve the correct centering of the bars in the laminated layer.

Figure 9:
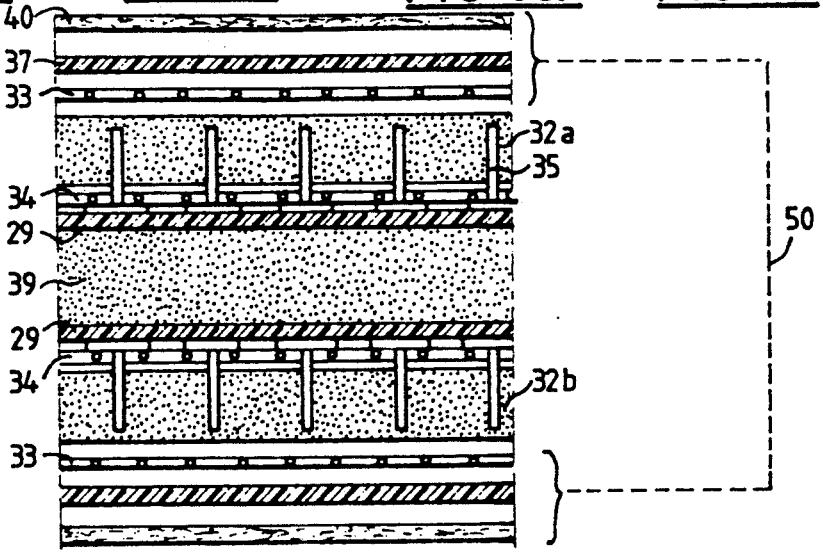

In FIG. 9, the sealed cover 29 constituting the central stratum is inside the supporting element. The outer walls of the cover 29 (act on e.g., impact) spikes 35 integrally joined to grids 34 and extending through compressible blocks **32*a*, 32*b*. The cover 29 contains a compressible pliable body 39 such as a cellular foam. The cover 29 is connected to a vacuum or pressure source in order to obtain a displacement of the spikes perpendicularly to the outer walls of the cover towards two outer grids 33**.

The outer strata respectively consisting of a protective wall 37, by an upholstery cover 40 and by the outer grids 33 remain at atmospheric pressure.

The grids 33, the walls 37 and the upholstery 40 are held in position by a spacing device 50 in order to maintain the spacing of the grids 33, while giving pliability to the supporting element assembly when the spikes 35 are not engaged positively in the meshes of the grids 33.

The operating mode of the supporting element depends on the initial spacing of the grids 34, 33 and on the length of the spikes 35.

In the case where the spikes 35 are not engaged in the grids 33 in the normal position, when the cover 29 is at atmospheric pressure, when the cover 29 is under a pressure greater than atmospheric pressure, the body 39 expands, the spikes 35 embed themselves in the grids 33 and the supporting element is rigidified.

Let us assume that the spikes 35 are engaged in the grids 33 in the normal position, when the cover 29 is at atmospheric pressure.

When the cover 29 is connected to a vacuum source, the body 39 contracts, the spikes 35 are released from the grids 33 and the supporting element is pliable again. In this case, the grids 33 and 34 are displaced parallel to each other when the supporting element is assuming its shape.

Re-establishment of atmospheric pressure enables the cover 29 to assume its normal size again, and the spikes 35 to engage in other meshes of the grids 33 in order to rigidify the supporting element in its new shape.

In this embodiment of the supporting element, the shape of the latter is maintained at atmospheric pressure, and the vacuum source is actuated only for the period necessary for the modifications of shape.

Without going beyond the scope of the invention, it is clear that the application of a sealed inner cover is equally appropriate in the example described with reference to FIGS. 3, 7*a*, 7*b*, 8*a*, 8*b*. In the latter case, the bars 38 will extend through the cover, the locally welded walls of which enable the creation of eyelets for the passage of the bars such as 38. Reciprocally, and by way of non-limiting example, the bars such as 38 can equally well replace the spikes 35 used in the illustrative embodiment in FIG. 9.

It is also understood that the supporting element can equally well be applied to the manufacture of mattresses, casts and splints which can be used in the medical field, and to the manufacture of molds or industrial packings.

We claim:

1. A body supporting cushion having an adjustable rigidity, comprising:

a gastight cover (29) adapted to selectively have a controlled inner pressure; and a filler (30) positioned within said cover (29) and having a plurality of superposed flexible strata (31, 32, 33; 33*a*, 32*b*; 34), said strata being movable relative to each other when a non-uniform distribution of a force is received by and compresses said filler (30) in the absence of said controlled inner pressure in said cover, and said strata including means located on either side of at least one of said strata for immobilizing said strata when said cover (29) is subjected to a change in its controlled inner pressure and for eliminating any relative displacement between said strata to give a predetermined rigidity to said supporting cushion, wherein said cover is adapted to be operatively connected to a pressure producing mechanism such that a pressure within said cover is adjustable, said strata including a plurality of grids (34) and said immobilizing means including a plurality of elongated members (35; 38), and wherein upon said cover being connected to said pressure producing mechanism, said elongated members interlock with said grids, and wherein upon said cover being disconnected from said pressure producing mechanism, said elongated members unlock from said grids.

2. A supporting cushion according to claim 1, wherein said immobilizing means is an embedding-type.

3. A supporting cushion according to claim 2, wherein said immobilizing means (35, 38) enables adjacent strata (33, 34) of said filler to be locked through compressible strata of said filler.

4. A supporting cushion according to claim 3, wherein said elongated members include a plurality of spikes (35), wherein a central stratum of said filler comprises a grid (33), said grid including meshes, the meshes comprising means for receiving said plurality of spikes (35) positioned on an adjacent stratum (34) of said filler and extending through a compressible stratum (32) of said filler.

5. A supporting cushion according to claim 3, wherein a central stratum of said filler comprises a plurality of spikes (35) positioned opposite one another and pointing towards a plurality of adjacent grids (33) through said compressible strata (32*a*, 32*b*).

6. A supporting cushion according to claim 3, wherein said elongated members comprise bars (38) linking adjacent grids (33) of said filler to at least one compressible stratum (32, 32*a*, 32*b*) of said filler.

7. A supporting cushion according to claim 6, wherein the bars (38) comprise means for spacing apart the grids (33) and extend through the compressible stratum (32, 32*a*, 32*b*).

8. A supporting cushion according to claim 1, wherein said pressure producing mechanism comprises a vacuum source.

9. A supporting cushion according to claim 1, wherein said elongated members include a plurality of spikes (35), a central stratum of said filler having two sets of said spikes (35) mounted opposite each other and integrally joined to respective ones of said plurality of grids (34).

10. A supporting cushion according to claim 1, wherein said elongated members comprise bars (38) having a central enlargement (38*b*) and extending through at least one compressible block (32, 32*a*, 32*b*) of said strata.

11. A supporting cushion according to claim 10, wherein said bars are integrally joined to a central stratum (34) of said filler.

12. A body supporting cushion, comprising:

an airtight cover (29);

a filler (30) being positioned within said cover, said filler comprising a plurality of layers (31, 32, 33, 32*a*, 32*b*, 34), said cover adapted to be operatively connected to a vacuum source, said filler including grid means (33, 34); and spike means for preventing relative displacement between said layers with respect to one another, said spike means adapted to cooperate with said plurality of layers of said filler and said grid means, wherein upon said cover being connected to said vacuum source, said spike means interlock with said grid means, and wherein upon said cover being disconnected from said vacuum source, said spike means unlock from said grid means.

13. A body supporting cushion, comprising:

an airtight internal element (29, 39) adapted to be operatively connected to a pressure source;

at least one filler disposed closely adjacent said internal element and comprising a plurality of layers of supporting material and grid means (33, 34), said grid means comprising a plurality of grids; and spike means extending outwardly from said airtight internal element and adapted to cooperate with said plurality of layers of said filler and said grid means, wherein when said airtight internal element is operatively connected to said pressure source, said spike means interlock with said grid means, and wherein when said airtight internal element is disconnected from said pressure source, said plurality of spike means are separated from said grid means.

14. A supporting cushion according to claim 13, wherein the airtight internal element includes a cover (29) having a compressible body (39) therein, the expansion and the contraction of which, under the effect of a variation in the pressure in the cover (29) displaces the spike means (35) in a direction to lock into or unlock from contact with grids (33) of said grid means.

15. A supporting cushion according to claim 14, wherein said plurality of layers comprises a protective wall (37), a second cover (40) and grids (33), said grids (33) including two outer grids, said wall (37), said second cover (40) and said two outer grids (33) being maintained at atmospheric pressure.

16. A supporting cushion according to claim 15, further comprising a spacing device (50), wherein said two outer grids (33), said wall (37), and said second cover (40) are held in position by said spacing device (50) to maintain a spacing between said two outer grids (33), said two outer grids including meshes adapted to receive said spike means, and said supporting element being pliable when said spike means (35) is disengaged from meshes of said two outer grids (33).

17. A supporting cushion according to claim 16, wherein said spike means (35) is disengaged from said two outer grids (33) in a first position when said cover (29) is at atmospheric pressure, and wherein when said cover (29) receives a predetermined pressure to have said predetermined inner pressure, said cover expands and said spike means (35) is embedded in said two outer grids (33) such that said supporting cushion becomes relatively rigid, said predetermined inner pressure being greater than said atmospheric pressure.

18. A supporting cushion according to claim 13, wherein said plurality of layers includes two outer grids (33) having said airtight internal element therebetween and two grids (34) adjacent to outer walls of said airtight internal element, said outer walls supporting said two grids (34) having a plurality of spike means (35) integrally joined thereto and extending through compressible blocks (**32*a*, 32*b*) of said layers of said at least one filler, said airtight internal element having a cover (29) and a compressible pliable body (39) therein, and wherein said airtight internal element is adapted to be operatively connected to a vacuum source to have said predetermined inner pressure and to displace said spike means perpendicularly to said outer walls of said airtight internal element towards two outer grids (33**) of said grid means.

* * * * *